US010883350B2

(12) United States Patent
Shen et al.

(10) Patent No.: US 10,883,350 B2
(45) Date of Patent: Jan. 5, 2021

(54) DEVICE AND METHOD FOR WATER DRAINAGE AND GAS PRODUCTION BY PRESSURE CONTROL AND GAS LIFT

(71) Applicants: Maohe Shen, Beijing (CN); Hongbao Xu, Beijing (CN)

(72) Inventors: Maohe Shen, Beijing (CN); Hongbao Xu, Beijing (CN)

( * ) Notice: Subject to any disclaimer, the term of this patent is extended or adjusted under 35 U.S.C. 154(b) by 282 days.

(21) Appl. No.: 15/773,161

(22) PCT Filed: Apr. 13, 2016

(86) PCT No.: PCT/CN2016/079119

§ 371 (c)(1),
(2) Date: May 2, 2018

(87) PCT Pub. No.: WO2017/075943

PCT Pub. Date: May 11, 2017

(65) Prior Publication Data

US 2018/0320492 A1 Nov. 8, 2018

(30) Foreign Application Priority Data

Nov. 2, 2015 (CN) ..... 2015 2 0863272 U

(51) Int. Cl.
*E21B 43/12* (2006.01)
*E21B 37/00* (2006.01)
(Continued)

(52) U.S. Cl.
CPC ..... *E21B 43/123* (2013.01); *E21B 34/08* (2013.01); *E21B 37/00* (2013.01); *E21B 43/006* (2013.01);
(Continued)

(58) Field of Classification Search
CPC ..... E21B 43/123; E21B 43/34; E21B 43/08; E21B 43/006; E21B 43/122;
(Continued)

(56) References Cited

U.S. PATENT DOCUMENTS

2009/0266554 A1* 10/2009 Wilson ..... E21B 43/122 166/372
2010/0252271 A1 10/2010 Kelley

FOREIGN PATENT DOCUMENTS

CN 1648405 A 8/2005
CN 101078339 A 11/2007
(Continued)

*Primary Examiner* — George S Gray
(74) *Attorney, Agent, or Firm* — Bayramoglu Law Offices LLC

(57) ABSTRACT

A device for water drainage and gas production by pressure control and gas lift and a method for collecting formation gas using the device for water drainage and gas production by pressure control and gas lift. The device for water drainage and gas production by pressure control and gas lift achieves water drainage and gas production by means of the combination of pressure control technology and gas lift technology, includes an inner tube, an intermediate tube, and an outer tube buried within a gas well and configured to be nested with each other, the inner tube being provided with a gas-lift valve and a pressure-control valve, the pressure-control valve being connected to a gas pressure source and being able to control the operation of the gas pressure source.

14 Claims, 4 Drawing Sheets

(51) Int. Cl.

| | |
|---|---|
| ***E21B 43/00*** | (2006.01) |
| ***E21B 43/34*** | (2006.01) |
| ***E21B 34/08*** | (2006.01) |
| ***E21B 43/10*** | (2006.01) |
| *E21B 33/04* | (2006.01) |

(52) U.S. Cl.
CPC ..... *E21B 43/108* (2013.01); *E21B 43/34* (2013.01); *E21B 33/04* (2013.01)

(58) Field of Classification Search
CPC ..... E21B 43/121; E21B 37/00; E21B 34/08; E21B 33/04; E21B 43/13; E21B 43/35
See application file for complete search history.

(56) References Cited

FOREIGN PATENT DOCUMENTS

| | | | |
|---|---|---|---|
| CN | 201517406 | U | 6/2010 |
| CN | 202596696 | U | 12/2012 |
| CN | 203257380 | U | 10/2013 |
| CN | 103790529 | A | 5/2014 |

* cited by examiner

DEVICE AND METHOD FOR WATER DRAINAGE AND GAS PRODUCTION BY PRESSURE CONTROL AND GAS LIFT

CROSS REFERENCE TO THE RELATED APPLICATIONS

This application is the national phase entry of International Application No. PCT/CN2016/079119, filed on Apr. 13, 2016, which claims priority from the Chinese Utility model application No. 201520863272.4 and titled as "Device for water drainage and gas production by pressure control and gas lift" filled in China on Nov. 2, 2015, and the entire contents of which are incorporated herein by reference.

TECHNICAL FIELD

The present invention relates to a device and a method for water drainage and gas production by pressure control and gas lift. In particular, the present invention relates to a device for achieving water drainage and gas production by means of a combination of a pressure control technology and a gas lift technology, and a method for performing collection of formation gas by using the device.

BACKGROUND

In the process of formation gas development, formation water needs to be constantly drained out to lower formation pressure.

Corresponding to production mechanism of formation gas, for example, coalbed methane, there are 3 stages as follows:

Stage 1 is a water drainage and pressure decrease stage, during which mainly coalbed water is drained out, and duration of production may be for several days or months;

Stage 2 is a normal drainage and production stage, during which the yield of coalbed methane is relatively stable and the yield of coalbed water gradually reduces, and this stage generally is a peak stage for gas production.

Stage 3 is a yield decline of coalbed methane stage, during which the yield of coalbed methane declines as the pressure decreases, being accompanied with the output of a small or trace volume of coalbed water.

In conclusion, the yield of coalbed water varies largely throughout the coalbed methane production process. The output of coalbed water is considerable in the early stage, then reduces into a relatively small or even very small. Therefore, in the adopted water drainage and gas production method we should consider changes of water drainage volumes both the early and later stages, a large application range, and a reasonable bottom hole pressure required to be able to be maintained so as to facilitate desorption of coalbed methane.

As regards production of coalbed methane, the water drainage and gas production is a core. Water drainage aims to reduce the bottom hole pressure to facilitate the desorption of coalbed methane. Different production stages have different drainage and production requirements, with the water drainage volume being considerable in the early stage and decreasing accordingly in the later stage. Since the purpose is gas production, in order to facilitate desorption of coalbed methane, a reasonable flowing bottom hole pressure should be maintained.

In order to achieve the above mentioned water drainage and gas production, current methods include:

A. Sucker-Rod Pump

A sucker-rod pump consists of an oil sucking machine on ground and a tubing pump in downhole, power is transmitted from the ground to the underground through a sucker rod, and a plunger of the oil sucking pump reciprocates under the drive of an oil sucking rod to lift liquid in a wellhole up to the ground, which is a special type of a reciprocating pump. During different stages of drainage and production, the pump type is adjusted according to changes of drainage volumes, and the frequency can be modulated by a speed control motor, an appropriate intensity of drainage and production can be selected according to the circumstance of each well. Such pumps are only applicable for wells with a small liquid drainage volume, less serious well deflection, and smaller output of sand and coal powder. Problems, such as pump jamming or eccentric wear and the like, often occur in wells with gas yields in huge or having sand output, thereby special downhole designs are required.

B. Screw Pump

A screw pump consists of a stator and a rotor. During production, as the rotor rotates, a closed space formed between the rotor and the stator is constantly relocated with the rotation of the rotor and moves forward gradually along the axial direction of the screw pump, and the liquid in the closed space will be drained into the ground as well. The closed space constantly formed at the lower end keeps moving upward with liquid consecutively, and the process is cycled in such a way to complete lift. The screw pump has a simple structure, a small occupied space, easy maintenance, and a relative large range of drainage capacity. Such pumps are applicable for drainage and production wells with a moderate water yield, problems of serious wear are caused by an excessively high gas-liquid ratio and exhaustion of pump. Once wear happens, the entire needs to be replaced, resulting in high costs.

C. Electric Submersible Pump

An electric submersible pump is a centrifugal pump submersed in a medium to be pumped. An electric pump unit device is sent to the downhole through an oil pipe, and a multistage centrifugal pump device rotates at a high speed to drain the fluid in a wellhole out of the oil pipe. The electric submersible pump has a large range of drainage capacity and a high pumping head. A relatively large production pressure difference can be created, with frequency conversion and speed adjustment being required according to liquid drainage volume changes. This pump has a small occupied ground area and space, is long in service life and convenient in management. The electric submersible pump has relatively strict requirements for power supply quality, accompanied by a certain requirement for the submergence depth of the pump. Usage of this centrifugal pump has rarely to be seen, as the present external environment and technical conditions are not mature enough.

D. Hydraulic Jet Pump

As a type of hydraulic pumps and without moving parts, hydraulic jet pumps adopt the principle that a ground high-pressure powered liquid transmits energy to a formation output liquid through nozzles, for achieving drainage and production. Firstly, the ground high-pressure power liquid is injected into an oil pipe through the nozzles, to convert pressure energy into kinetic energy. The speedily jetted fluid is mixed with the surrounding liquid for completion of energy transmission. When the mixed liquid, which also flows at a very high speed, is spread out through the nozzles, the area is instantly enlarged, and kinetic energy is converted into pressure energy. The downhole pressure is increased, the liquid is drained into the ground under the function of the pressure. The pump has a large range of theoretical drainage volume and is resistant to wear and corrosion due to the downhole equipment having no moving parts, however, is low in lift efficiency, below 25%. To prevent gaseous corrosion, a relatively high suction pressure and submergence depth are required. The pump has huge ground equipment, high maintenance costs, and a relatively high working pressure, which fails to satisfy the requirement for the production pressure difference of coalbed methane.

E. Conventional Gas Lift Method

Gas lift is a lift method in which an external high-pressure gas is injected into a gas lift pipe at a certain depth of an oil pipe. The injected high-pressure gas enters the wellhole liquid, so as to reduce the density of the liquid column in the wellhole, reduce slippage, and lower the flowing bottomhole pressure. Convention gas lift conducts gas inlet from a sleeve and liquid drainage from the oil pipe. The gas lift process itself, without moving parts, is simple in structure, and is not subject to impacts from solid particles or gases. The gas lift method has a large range of drainage capacity, and is suitably applied for highly-deviated wells. The method is applicable for the early stage of water drainage and gas production, which has a large drainage volume. In the later stage, the gas lift method is limited due to a small volume of formation water.

F. Double-Pipe Gas Lift Method

For example, in 2013, a Chinese utility model titled as "a novel device for drainage and production of coalbed methane", with publication No. CN 203257380 U, disclosed newly a novel device for drainage and production of coalbed methane by gas lift. The device consists of major components such as a double-wall pipe, a single-wall pipe, a gas-liquid mixer, a gas lift check valve, a check valve, and so on. A control system calculates the pressure and exhaust volume of the compressed air being used, based on data from a liquid level collection device. The compressed air is then from an injection port of the compressed air, injected into an annulus between an outer pipe and an inner pipe of the double-wall pipe. After sufficient mixing in the gas-liquid mixer through the check valve, a gas-liquid mixture, driven by the gas lift check valve, flows through an inner chamber of the inner pipe of the double-wall pipe, to arrival at a drainage outlet for a gas-liquid mixed fluid and then is drained out. This technique avoids problems that are caused during traditional technique for drainage and production of coalbed methane, such as eccentric wear, pump jamming, motor overheating and the like. Meanwhile, the problem of multiphase mixing of gases and liquids in input/output is avoided, which facilitates the production of coalbed methane.

For the above mentioned double-pipe gas lift method, a liquid level collection device needs to be mounted at a wellhead, so that the control system can utilize the collected data for calculation and control of the pressure and compressed air volume from the compressor, which is rather complicated for practical operation.

The gas lift method is likewise only applicable for the early stage of water drainage and gas production, during which the drainage volume is large. In the later stage of drainage and production, this technique is also limited due to a small volume of formation water. Moreover, despite complex downhole conditions, such gas lift method fails to take into consideration of functions for filtering and well cleaning upon pollution either, which unavoidably leads to the increase of well repair costs.

To sum up, all of the above-mentioned prior art have technical defects. Particularly, sucker-rod pumps are mature in technology and simple to operate, yet with inadaptability for requirements of the changes of the liquid drainage volumes in different stages of drainage and production, as well as serious problems of eccentric wear and pump jamming always threaten site production. Despite a simple structure and small occupied space of screw pumps, a low water yield is in the later stage of drainage and production, burnout of screw pumps easily occurs upon exhaustion; the whole set of downhole device must be replaced in case of serious wear. Despite a relatively large drainage capacity, electric submersible pumps have strict requirements for working conditions and are very costly, with problems easily caused by an insufficient submergence depth in the later stage of drainage and production. Hydraulic jet pumps have a large theoretical drainage capacity range and high wear and corrosion resistance, yet low lift efficiency, high maintenance costs, and a higher working pressure that cannot meet the requirement for production pressure differences of coalbed methane. The gas lift is applicable for the early stage of water drainage and gas production with a large drainage volume, but is limited in the later stage of drainage and production due to a low yield of formation water. A drainage and production device of the double-pipe gas lift method newly disclosed in 2013 is only applicable for the early stage of liquid drainage and gas production, when the drainage volume is large, and the ground control equipment is too complicated to maintain. Therefore, water drainage and gas production processes in the prior art all have defects, failing to meet special requirements of coalbed methane production, to consider drainage volume changes both in the early and the later stages, which is not able to maintain a reasonable bottom hole pressure, and facilitate the desorption of coalbed methane.

SUMMARY

In order to solve the above mentioned defects in the prior art, the present invention aims to provide a device and method for water drainage and gas production by pressure control and gas lift as follows: the pressure control and gas lift technologies are combined, so that an ordinary gas pressure source (an air compressor) can be used to meet the water drainage volume requirements in different stages; while maintaining the production pressure, a pressure-control valve (a downhole control valve) can automatically control the start and stop of the air compressor, so that the working efficiency is improved; the device also avoids problems in the traditional drainage and production process, such as eccentric wear, pump jamming, pump burnout and the like; with a wide application range, the device can be used for one device in multiple wells and cluster wells; after downhole gas-liquid separation, separation of an input gas and an output gas needn't be carried out independently on the ground, the device is simple in configuration and convenient in maintenance, and meets the requirement of modern water drainage and gas production for long-lasting, effective and stable production and reduced consumption; functions of downhole filtering and well self-cleaning can also be achieved.

In order to fulfill the above purpose, the present invention adopts the following technical solution.

The present invention provides a device for water drainage and gas production by pressure control and gas lift as follows, the device for water drainage and gas production by pressure control and gas lift is used for collecting formation gas, the device for water drainage and gas production by pressure control and gas lift comprises an inner pipe, an intermediate pipe and an outer pipe which are used for being buried in a gas well and configured to be nested with each other; a first space inside the inner pipe is communicated with a gas pressure source and a gas-liquid separation device; a second space, which is surrounded between the inner pipe and the intermediate pipe, is communicated with the gas pressure source and the gas-liquid separation device; a third space, which is surrounded between the intermediate pipe and the outer pipe, is communicated with a collecting channel of the formation gas; the first space and the second space can be communicated in a unidirectional manner, and the second space and the third space can be communicated in a bidirectional manner; gas lift valves, and a pressure-control valve that is opened or closed based on the pressure in the second space, are arranged on the inner pipe; the pressure-control valve is connected with the gas pressure source, and can control the operation of the gas pressure source.

Preferably, arranged at the bottom of the inner pipe is a check valve through which the communication from the second space to the first space can be achieved in a unidirectional manner, and a first sieve pipe is arranged at the bottom of the inner pipe and below the check valve and used for filtering out impurities, and an end plug is arranged below the first sieve pipe.

More preferably, arranged at the bottom of the intermediate pipe is a bidirectional valve through which the second space and the third space can be communicated in a bidirectional manner, and a second sieve pipe is arranged at the bottom of the intermediate pipe and below the bidirectional valve, and used for filtering out impurities.

Further, preferably, the inner pipe, the intermediate pipe and the outer pipe are concentrically arranged, at a formation gas wellhead arranged is a first pipe hanger used for fixing the inner pipe and communicated with the inner pipe, and/or a second pipe hanger used for fixing the intermediate pipe and communicated with the intermediate pipe.

Further, preferably, in the vertical height direction, both the bottom of the intermediate pipe and the bottom of the outer pipe are located below the formation containing the formation gas.

Further, preferably, the gas lift valves and the pressure-control valve are sequentially arranged on the inner pipe from top to bottom.

Further, preferably, a compressor can be used for compressing natural gas or nitrogen gas.

The present invention also provides a method for water drainage and gas production by pressure control and gas lift, the method makes use of the device for water drainage and gas production by pressure control and gas lift according to any technical solution of the above-mentioned technical solutions, the method comprises the following stages: a. water drainage and pressure decrease stage, under an initial state full of the well liquid among the first space, the second space and the third space, the gas pressure source is used to input a powered gas to the second space, the well liquid is sustainably gas-lifted by the gas lift valves from the first space, in this stage, the well liquid in the third space enters the second space, the well liquid in the second space enters into the first space, the well liquid in the first space is gradually gas-lifted and output into the gas-liquid separation device; b. water drainage and gas production stage, after the water drainage and pressure decrease stage, the gas pressure source is used to continually input the powered gas into the second space, with the decrease of the pressure in the third space, the fluid in the formation containing water and formation gas flows into the third space, both the bottom of the intermediate pipe and the bottom of the outer pipe are located below the formation, the formation gas enters the third space and is output upwards, the water enters the third space to form the well liquid, the well liquid enters downwards the second space and enters the first space via the second space, and then is gas-lifted and output; c. continuous drainage and production stage, after the water drainage and gas production stage, the gas pressure source is used to input the powered gas into the first space, the pressure-control valve and the gas pressure source are used to maintain the preset pressure in the first space and the second space, and the well liquid is drained out via the second space and the formation gas is produced from the third space.

Preferably, in the continuous drainage and production stage, the inner pipe is closed so that the first space and the second space are communicated controllably by the pressure-control valve, and the pressure-control valve makes that: when the pressure of the well liquid in the second space reaches a set value, the powered gas in the first space enters the second space and automatically gas-lifted by gas lift the well liquid in the second space, and when the pressure of the well liquid in the second space is below the set value, the gas pressure in the first space rises gradually, when the gas pressure in the first space reaches a set pressure value, the gas pressure source stops, and the gas pressure in the first space is below the set pressure value, the gas pressure source starts to work, and throughout the continuous drainage and production stage, the pressure-control valve is automatically opened and closed as the well liquid in the second space increases or decreases, the gas pressure in the first space controls the start and stop of the gas pressure source, and then maintaining the preset pressure in the first space and the second space.

More preferably, the method comprises the following stages: d. cleaning stage, the first space is closed, and the water is injected into the second space to conduct the cleaning, and impurities in the device for water drainage and gas production by pressure control and gas lift are washed out from the third space, and then the water drainage and pressure decrease stage, the water drainage and gas production stage and the continuous drainage and production stage are repeated in succession to recover production.

Further, preferable, in the cleaning stage, the bidirectional valve arranged at the bottom of the intermediate pipe is opened reversely under a condition of a high pressure, and water flows from the second space through the bidirectional valve in the third space, and then flows to the ground from the third space to complete the cleaning.

By use of the above technical solution, the present invention provides a device and method for water drainage and gas production by pressure control and gas lift as follows: the device combines pressure control technology and gas lift technology so that an ordinary gas pressure source (an air compressor) can be used to meet the water drainage volume requirements in different stages; while maintaining the recovery pressure, a pressure-control valve (a downhole control valve) can automatically control the start and stop of the air compressor, so that the working efficiency is improved; the device also avoids problems in the traditional drainage and production process, such as eccentric wear, pump jamming, pump burnout and the like; with a wide application range, the device can be used for one device in multiple wells and cluster wells; after downhole gas-liquid separation, separation of an input gas and an output gas needn't be carried out independently on the ground, the device is simple in configuration and convenient in maintenance, and meets the requirement of modern water drainage and gas production for long-lasting, effective and stable production and reduced consumption; and functions of downhole filtering and well self-cleaning can also be achieved.

DESCRIPTION OF REFERENCE NUMBERS IN THE DRAWINGS

Figure 1:
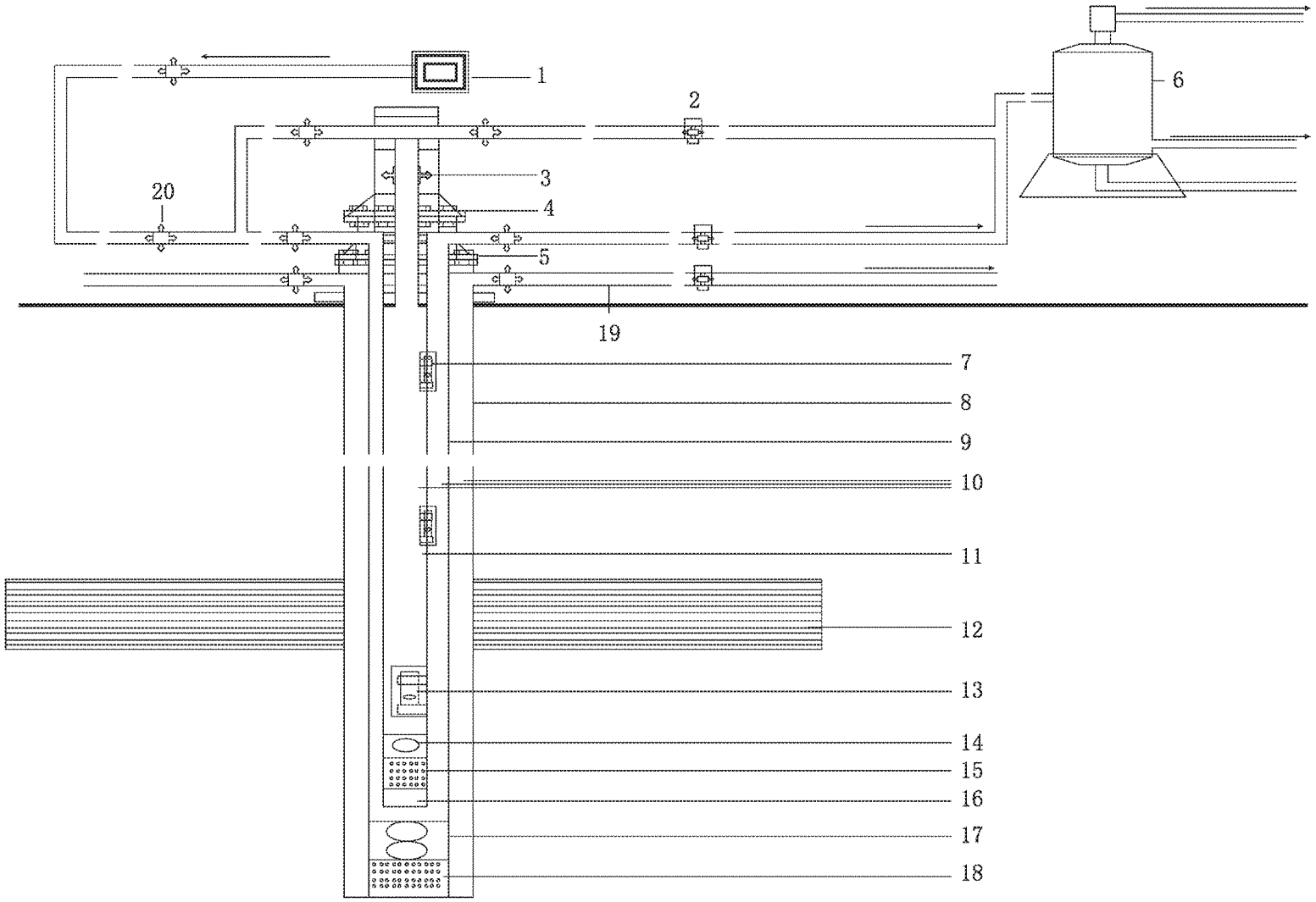
FIG. 1 is a connection structure diagram of a device for water drainage and gas production by pressure control and gas lift according to one embodiment of the present invention.

1 Air compressor 2 Liquid transportation control valve 3 Gas inlet control valve 4 Small oil pipe hanger
5 Large oil pipe hanger 6 Gas-liquid separator 7 Downhole gas lift valve 8 Sleeve
9 Large oil pipe 10 Well liquid 11 Small oil pipe 12 Coalbed methane formation
13 Downhole control valve 14 Check valve 15 Small sieve pipe 16 End plug
17 Bidirectional valve 18 Large sieve pipe 19 Collecting and transportation pipeline 20 Gas transportation control valve

DETAILED DESCRIPTION OF THE EMBODIMENTS

Hereinafter, the specific embodiment of the present invention is explained by combination of the drawings, wherein the production of coalbed methane will be taken as an example to explain the device and method for water drainage and gas production by pressure control and gas lift of this invention.

FIG. 1 is a connection structure diagram of a device for water drainage and gas production by pressure control and gas lift according to an embodiment of the present invention. As shown in FIG. 1, in this embodiment, the device for water drainage and gas production by pressure control and gas lift comprises a small oil pipe 11, a large oil pipe 9 and a sleeve 8 which are buried in a coalbed methane well and configured to be nested with each other. The small oil pipe 11, the large oil pipe 9 and the sleeve 8 are concentrically arranged. At a coalbed methane wellhead, a small oil pipe hanger 4 which is arranged for fixing the small oil pipe 11 and communicated with the small oil pipe 11, and a large oil pipe hanger 5 which is arranged for fixing the large oil pipe 9 and communicated with the large oil pipe 9, are arranged. The small oil pipe hanger 4 and the large oil pipe hanger 5 are concentrically arranged. A channel is formed in the small oil pipe hanger 4 and communicated with a space (a first space) inside the small oil pipe 11, and a channel is formed in the large oil pipe hanger 5 and communicated with a small annulus (a second space) between the small oil pipe 11 and the large oil pipe 9, so that the inner space of the small oil pipe 11 is communicated with an air compressor 1 and a gas-liquid separator 6, and the small annulus, which is surrounded between the small oil pipe 11 and the large oil pipe 9, is also communicated with the air compressor 1 and the gas-liquid separator 6; a large annulus (a third space), which is surrounded between the large oil pipe 9 and the sleeve 8, is communicated with a coalbed methane collecting channel (a part of a collecting and transportation pipeline 19 that is used for collecting coalbed methane); one valve or more valves of a liquid transportation control valve 2, a gas inlet control valve 3, a gas transportation control valve 20, is/are arranged on each communication channel and used for controlling channel being opened and closed, for achieving the purpose that the opening and closing of each of the channels can be controlled according to the working process.

Moreover, the space in the small oil pipe 11 and the small annulus are communicated in a unidirectional manner in all of the different stages of gas production, and the communication direction can vary in different stages. The small annulus and the large annulus are communicated in a unidirectional manner in all of the different stages, and the communication direction can vary in different stage.

After all of the small oil pipe 11, the large oil pipe 9 and the sleeve 8 are arranged in a coalbed methane well, in the vertical height direction, the bottom of the large oil pipe 9 and the bottom of the sleeve 8 are both located below a coalbed methane formation 12, so as to make sure that the water drainage and gas production process can be smoothly carried out.

Moreover, a plurality of gas lift valves 7 and a downhole control valve 13 located below the gas lift valves 7 and used for monitoring and maintaining the pressure of the small annulus in the normal stage of drainage and production, are arranged on the small oil pipe 11. The downhole control valve 13 is connected with the air compressor 1. In the normal stage of drainage and production, the downhole control valve 13 controls, according to the pressure of the small annulus, the connection/disconnection between the space inside the small oil pipe 11 and the small annulus, and controls, according to the pressure of the space in the small oil pipe 11, the operation (start and stop) of the air compressor 1.

A check valve 14 is arranged at the bottom of the small oil pipe 11, so as to achieve the unidirectional communication from the small annulus to the space in the small oil pipe 11. A small sieve pipe 15 is arranged at the bottom of the small oil pipe 11 and below the check valve 14, and used for filtering out impurities. An end plug 16 is further arranged below the small sieve pipe 15, so as to ensure that a well liquid 10 flowing into the small oil pipe 11, is always firstly filtered through the small sieve pipe 15.

A bidirectional valve 17 is arranged at the bottom of the large oil pipe 9, so as to make sure that the small annulus and the large annulus can be communicated in a bidirectional manner. A large sieve pipe 18 for filtering is arranged at the bottom of the large oil pipe 19 and below the bidirectional valve.

Figure 2:
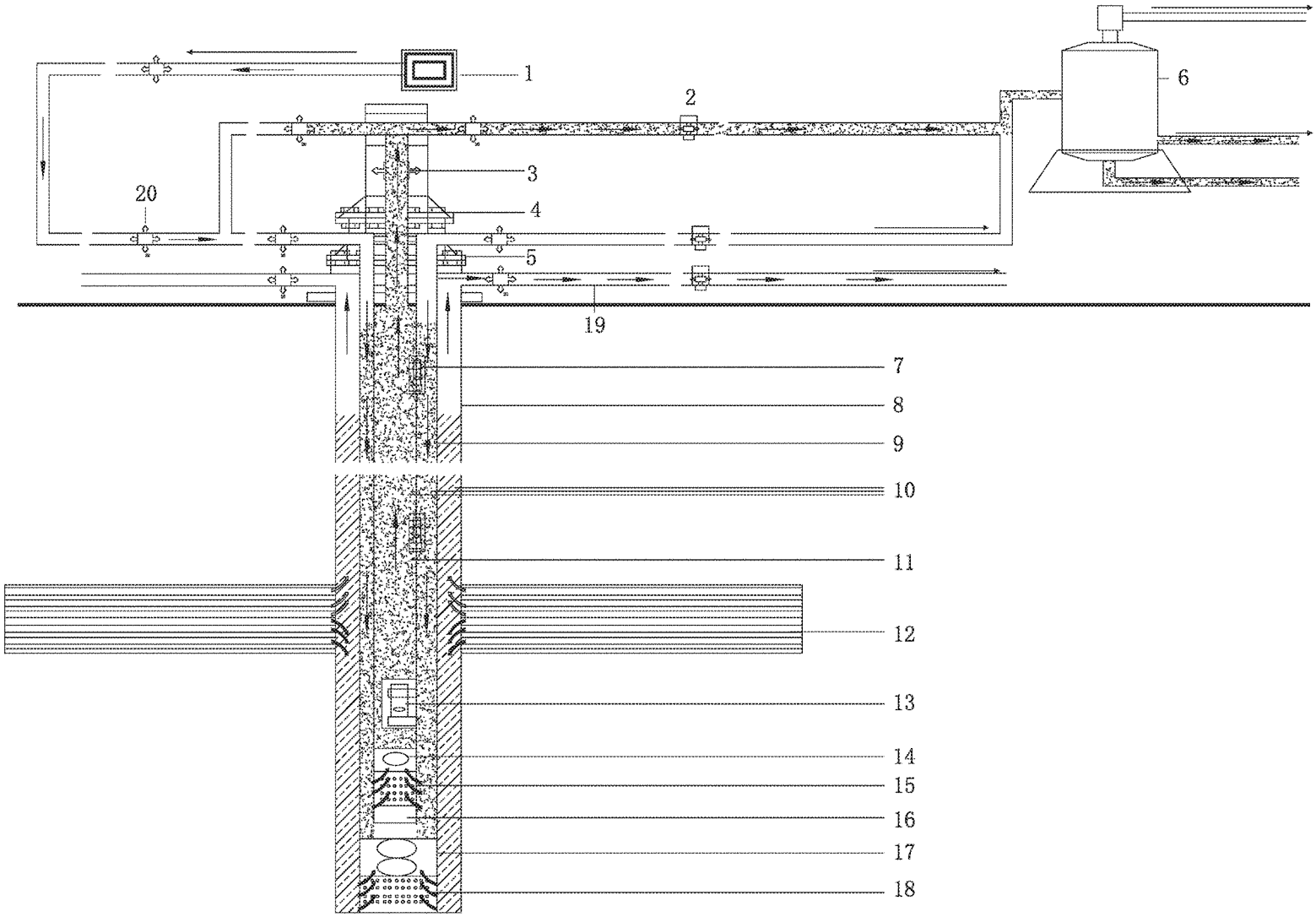
FIG. 2 is an operation diagram of the device for water drainage and gas production by pressure control and gas lift shown in FIG. 1, which illustrates the operation diagram of the device for water drainage and gas production by pressure control and gas lift in the early stage of water drainage and pressure decrease.
Figure 3:
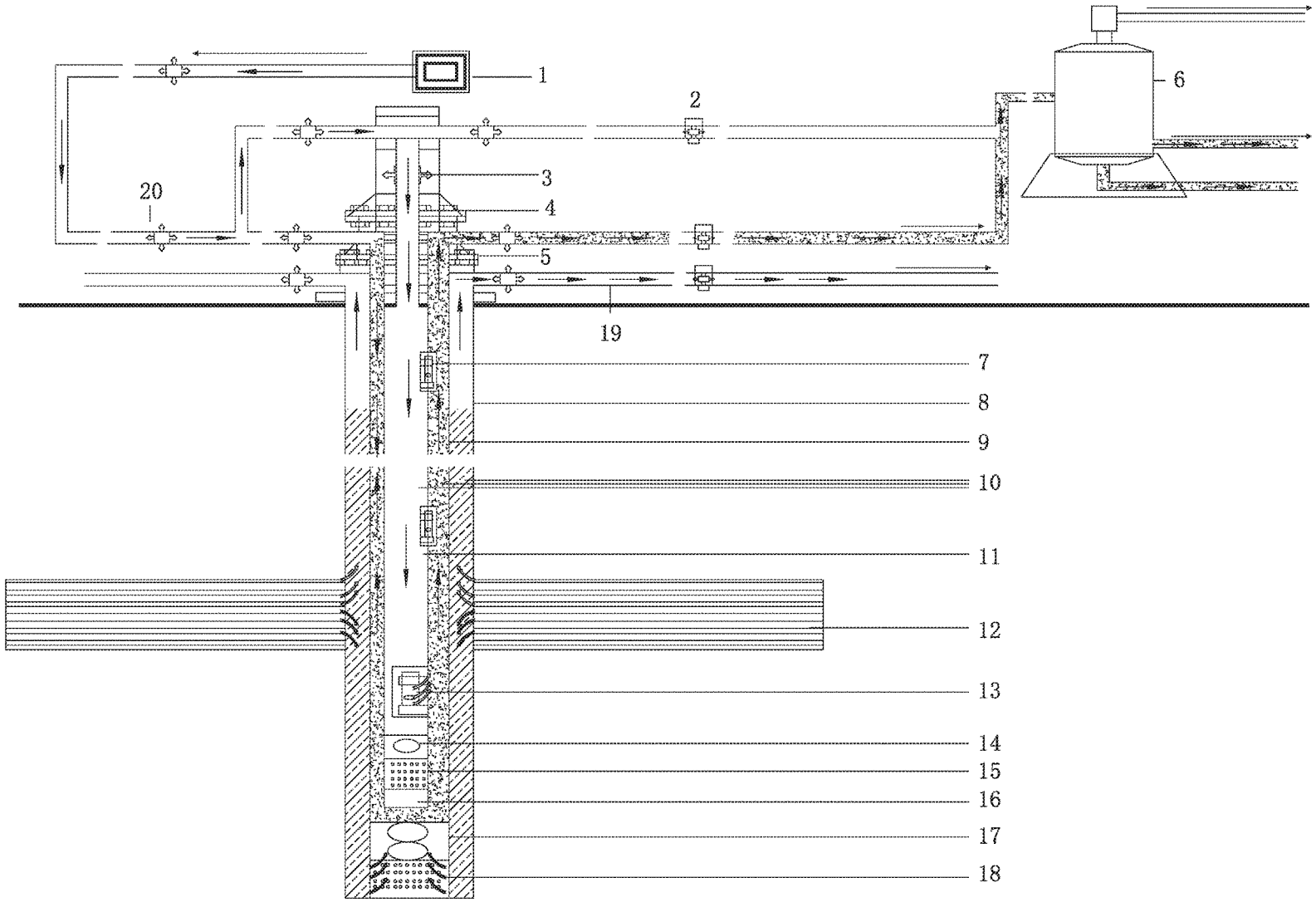
FIG. 3 is an operation diagram of the device for water drainage and gas production by pressure control and gas lift shown in FIG. 1, which illustrates the operation diagram of the device for water drainage and gas production by pressure control and gas lift in the normal stage of drainage and production.

In this embodiment, the device for water drainage and gas production by pressure control and gas lift, as the way described above, configures the air compressor 1, the liquid transportation control valve 2, the gas inlet control valve 3, the small oil pipe hanger 4, the large oil pipe hanger 5, the gas-liquid separator 6, the downhole gas lift valves 7, the sleeve 8, the large oil pipe 9, the small oil pipe 11, the downhole control valve 13, the check valve 14, the small sieve pipe 15, the end plug 16, the bidirectional valve 17, the large sieve pipe 18, the collecting and transportation pipeline 19, and the gas transportation control valve 20. Hereafter, with the combination of FIGS. 2-4, the working process of the device for water drainage and gas production by pressure control and gas lift of this embodiment is explained.

a. As shown in FIG. 2, in the early stage of large-volume water drainage, a powered gas enters the space (the small annulus) between the large oil pipe 9 and the small oil pipe 11, and the liquid is gas-lifted (lifted) from the small oil pipe 11 through the plurality of gas lift valves 7 mounted on the small oil pipe 11. During the process, gas lift is continuous, and the liquid transportation control valve 2 controls the flow volume so as to maintain a steady pressure decrease in the whole device. In this stage, the well liquid 10 in the small annulus can only enter the small oil pipe 11 through the small sieve pipe 15 and the check valve 14, and then the well liquid 10 in the small oil pipe 11 is gradually gas-lifted and transported to the gas-liquid separator 6 on the ground. In this stage, the bidirectional valve 17 at the bottom of the large oil pipe 9 serves as a check valve which is able to flow upwards. The well liquid in the sleeve 8 (the large annulus) can only enter the small annulus through the bidirectional valve 17 and the large sieve pipe 18.

b. As the pressure of the large annulus decreases, water and coalbed methane in the coalbed methane formation 12 start to move towards the large annulus. The bottoms of the large oil pipe 9 and the sleeve 8 are located below the coalbed methane formation 12, so that the coalbed methane in a free state, enter the large annulus and then is outputted vertically and upwards, and the water moves downwards, passes through the bottom of the large oil pipe 9 and enters the small annulus, then enters the small oil pipe 11 through the small annulus, is output in a gas-lift manner.

c. As shown in FIG. 3, in the normal drainage and production stage, the powered gas enters from the small oil pipe 11 in this stage, and the liquid is drained out via the small annulus. During the process, the check valve 14 is closed. The downhole control valve 13, as a key downhole device, is arranged above the check valve 14, so that when the liquid column pressure in the small annulus reaches a set value, the valve is automatically opened, and the powered gas in the small oil pipe 11 enters the small annulus, automatically gas lift the well liquid 10 by gas lift in the small annulus; when the liquid column pressure in the small annulus is lower than the set value, the valve is automatically closed, after which the gas pressure value in the small oil pipe 11 is gradually increased. When the gas pressure in the small oil pipe 11 reaches a preset pressure value, the air compressor 1 stops; when the gas pressure in the small oil pipe 11 is lower than the preset pressure value, the air compressor 1 starts to work. Coalbed methane is produced in the large annulus, throughout the gas recovery stage.

Figure 4:
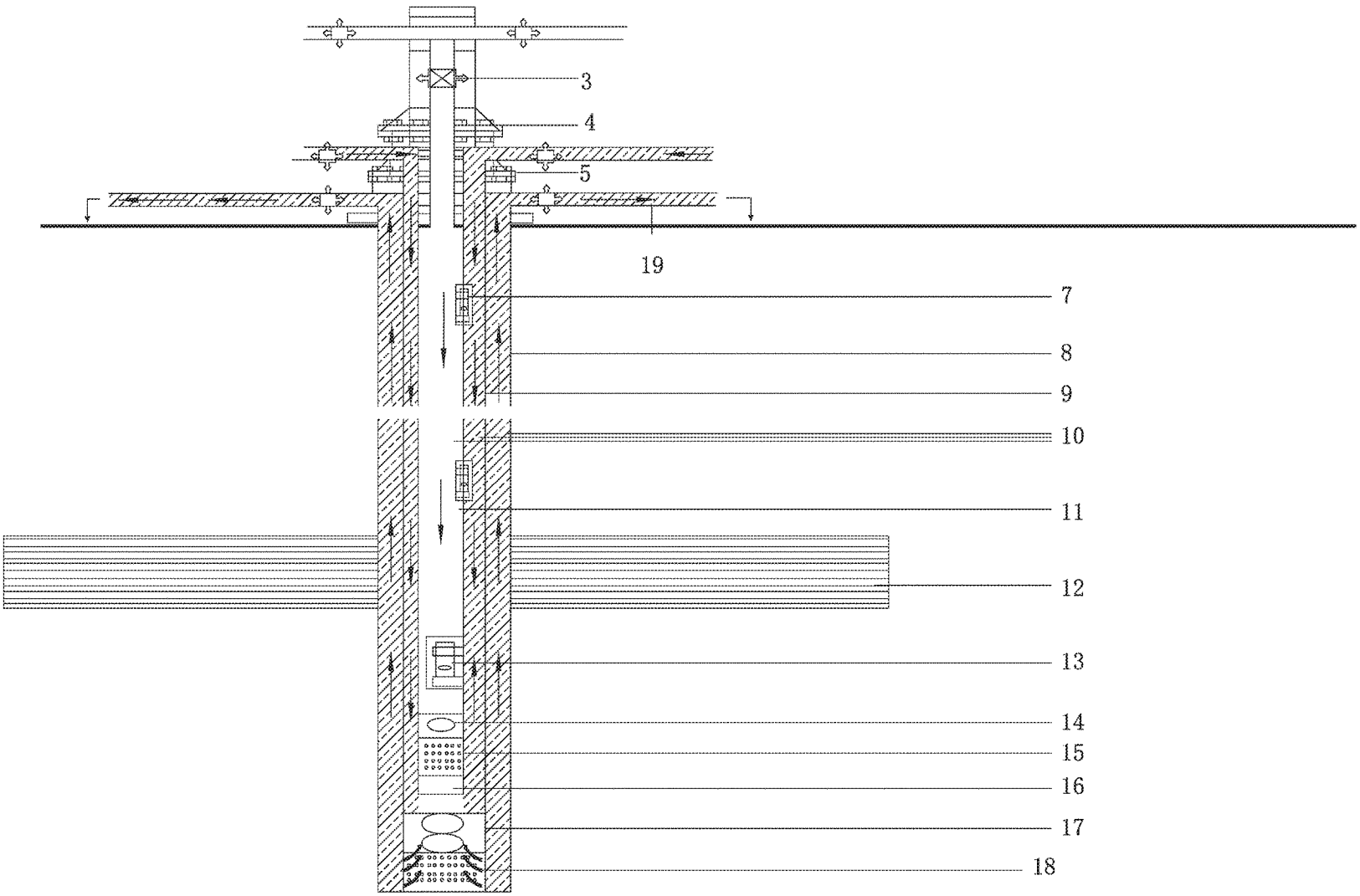
FIG. 4 is an operation diagram of the device for water drainage and gas production by pressure control and gas lift shown in FIG. 1, which illustrates the well cleaning operation diagram of the device for water drainage and gas production by pressure control and gas lift.

In this stage, the downhole control valve 13 is automatically opened or closed following the accumulated liquid's rising and falling in the small annulus, and automatic start and stop of the air compressor 1 are controlled through the gas pressure in the small oil pipe 11. The process is cycled to constantly lift up the water flowing out of the coalbed methane formation 12.

d. When well cleaning is needed, as shown in FIG. 4, the small oil pipe 11 is closed by closing the gas inlet control valve 3, water with a large volume and a high pressure from the small annulus is injected to conduct cleaning to remove bottom hole impurities from the large annulus through backwashing, and then steps a, b and c are repeated to recover production. During well cleaning, the bidirectional valve 17 at the bottom of the large oil pipe 9 is opened reversely under the high pressure, and the injected water flows from the small annulus to the large annulus through the bidirectional valve 17 and the large sieve pipe 18, and then flows from the large annulus to the ground to complete well cleaning.

The device of the present invention adopts the structure in above-described embodiment and working process to be able to fully fulfill the purpose of the present invention. However, explanations to be further provided include:

1. Although in the drawings in the above-mentioned specific embodiment shown only is the device for water drainage and gas production by pressure control and gas lift which is inserted into the coalbed methane well in a vertical manner, the present invention is not restricted to such arrangement. The device for water drainage and gas production by pressure control and gas lift, provided by the present invention, can be inserted into the coalbed methane well in an inclined manner.

2. In the present invention, "communicated in a unidirectional manner" means the large oil pipe 9 and the small oil pipe 11 are communicated in a unidirectional manner in all the stages of coalbed methane drainage and production, but the communication direction can vary in different stages. For example, in the early stage of water drainage and pressure decrease, the well liquid 10 in the small annulus, which is between the large oil pipe 9 and the small oil pipe 11, is only allowed to flow into the small oil pipe 11 through the check valve 14. However, in the normal stage of drainage and production, the gas in the small oil pipe 11 is allowed to enter the small annulus through the downhole control valve 13.

3. Although in the above-mentioned embodiment, the large oil pipe 9, the small oil pipe 11 and the sleeve 8 are concentrically arranged, the present invention is not restricted to this. As needed, the large oil pipe 9, the small oil pipe 11 and the sleeve 8 can be arranged in a non-concentric manner. The large oil pipe hanger 5 and the small oil pipe hanger 4 can also be arranged in a non-concentric manner.

4. The present invention can adopt the following alternate technical solution which adopts a concentric double pipe; the large oil pipe 9 and the small oil pipe 11 respectively serve as a liquid drainage channel and a gas lift gas supply channel in different stages, the sleeve is used for gas production; the downhole gas lift valves 7 and the downhole control valve 13 are mounted on the small oil pipe 11. In practice, the large oil pipe 9 and the small oil pipe 11 can also be replaced by a combination of an ordinary oil pipe and a hollow sucker rod respectively, and the downhole gas lift valves 7 and the downhole control valve 13 can be mounted on a hollow sucker rod.

5. Furthermore, in the above-mentioned technical solution of the present invention, the downhole gas lift valves 7 and the downhole control valve 13 are mounted on the small oil pipe 11. In practice, if the coalbed methane formation is the buried in a shallow depth, the downhole gas lift valves 13 also can be only mounted on the small oil pipe 11. In such circumstance, Step a can be omitted, and the production process is carried out in the order of Steps c and b.

6. Although in the above specific embodiment, coalbed methane is taken as an example to explain the device and method of the present invention, but the formation gas related in this invention is not only limited to the coalbed methane. The formation gas of this invention also comprises shale gas, non-condensable gas and so on.

By use of the above-mentioned specific technical solution, the present invention has the following advantages: the device is simple, the device disclosed by the present invention is simple in structure, this invention adopts a conventional device but it can totally meet special requirements of coalbed methane production; low in costs, problems such as eccentric wear, pump jamming, and pump burnout and the like do not exist by means of the gas lift process to drain liquid; the pipe columns itself have the functions of filtering and well self-cleaning, so that pollution of the pipe columns can be reduced due to the filtering function, and the well self-cleaning function can provide a well cleaning solution for the pollution, without removal of the pipe columns; achieving downhole gas-liquid separation, an ordinary air compressor 1 is used after the gas-liquid separation, thereby complex separation treatment of coalbed methane on the ground is no needed; the operation of an ground compressor is controlled by the downhole control valve 13, and an air compressor can be used for multiple wells and cluster wells, then the operation efficiency is improved.

Moreover, as a key device, the downhole control valve 13 also can be provided with a special fishing tool for easier replacements.

The protection scope of the present invention is not restricted to the specific example of the above specific embodiment, and what satisfies any combination of features in claims of the present invention will be fallen into the protection scope of the present invention.

The invention claimed is:

1. A device for water drainage and gas production by pressure control and gas lift for collecting formation gas, comprising:

an inner pipe, an intermediate pipe and an outer pipe buried in a coalbed methane well and configured to be nested with each other, a first space inside the inner pipe is in fluid communication with an air compressor and a gas-liquid separation device;

a second space is provided between the inner pipe and the intermediate pipe, wherein the second space is in fluid communication with the air compressor and the gas-liquid separation device; and a third space is provided between the intermediate pipe and the outer pipe, wherein the third space is in fluid communication with a collecting channel for the coalbed methane;

wherein, the first space and the second space fluidly communicate in a unidirectional manner, and the second space and the third space fluidly communicate in a bidirectional manner;

gas lift valves and a pressure-control valve are arranged on the inner pipe, wherein the pressure-control valve is opened or closed based on the pressure in the second space;

the pressure-control valve is connected with the gas pressure source, and controls the operation of the air compressor.

2. The device for water drainage and gas production by pressure control and gas lift according to claim 1, further comprising a check valve arranged at a bottom of the inner pipe for achieving the unidirectional communication from the second space to the first space.

3. The device for water drainage and gas production by pressure control and gas lift according to claim 2, further comprising a first sieve pipe arranged at the bottom of the inner pipe and below the check valve for filtering out impurities, and an end plug is arranged below the first sieve pipe.

4. The device for water drainage and gas production by pressure control and gas lift according to claim 1, further comprising a bidirectional valve arranged at a bottom of the intermediate pipe for achieving the bidirectional communication between the second space and the third space.

5. The device for water drainage and gas production by pressure control and gas lift according to claim 4, further comprising a second sieve pipe arranged at the bottom of the intermediate pipe and below the bidirectional valve, for filtering out impurities.

6. The device for water drainage and gas production by pressure control and gas lift according to claim 1, wherein the inner pipe, the intermediate pipe and the outer pipe are concentrically arranged.

7. The device for water drainage and gas production by pressure control and gas lift according to claim 1, further comprising a first pipe hanger arranged at a wellhead of a gas well for fixing the inner pipe and communicating with the inner pipe; and/or a second pipe hanger arranged at the wellhead of the gas well for fixing the intermediate pipe and communicating with the intermediate pipe.

8. The device for water drainage and gas production by pressure control and gas lift according to claim 1, wherein in a vertical height direction, the bottom of the intermediate pipe and the bottom of the outer pipe are both located below a formation containing the coalbed methane.

9. The device for water drainage and gas production by pressure control and gas lift according to claim 1, wherein the gas lift valves and the pressure-control valve are sequentially arranged on the inner pipe from top to bottom.

10. A method for water drainage and gas production by pressure control and gas lift, comprising:

utilizing a device for water drainage and gas production by pressure control and gas lift for collecting formation gas, wherein, the device comprises an inner pipe, an intermediate pipe and an outer pipe buried in a coalbed methane well and configured to be nested with each other, a first space inside the inner pipe is in fluid communication with an air compressor and a gas-liquid separation device;

a second space is provided between the inner pipe and the intermediate pipe, wherein the second space is in fluid communication with the air compressor and the gas-liquid separation device; and a third space is provided between the intermediate pipe and the outer pipe, wherein the third space is in fluid communication with a collecting channel for the coalbed methane;

wherein, the first space and the second space fluidly communicate in a unidirectional manner, and the second space and the third space fluidly communicate in a bidirectional manner;

gas lift valves and a pressure-control valve are arranged on the inner pipe, wherein the pressure-control valve is opened or closed based on the pressure in the second space;

the pressure-control valve is connected with the air compressor, and controls the operation of the air compressor.

11. The method of claim 10, further comprising the following stages:

a. water drainage and pressure decrease stage, under an initial state that the first space, the second space and the third space are full of well liquid, activating the air compressor to input pressurized gas into the second space, gas-lifting the well liquid from the first space by adjusting the gas lift valves, in this stage, in a controlled manner by adjusting the gas lift valves and turning the pressure-control valve on and off in response to pressure changes in the spaces, the well liquid in the third space enters the second space, the well liquid in the second space enters into the first space, the well liquid in the first space is gas-lifted and output into the gas-liquid separation device;

b. water drainage and gas production stage, after the water drainage and pressure decrease stage, using the air compressor to continually input the pressurized gas into the second space, with the decrease of the pressure in the third space, the fluid in the formation containing water and formation gas flows into the third space, both the bottom of the intermediate pipe and the bottom of the outer pipe are located below the formation, the formation gas enters the third space and is output upwards, the water enters the third space to form the well liquid, the well liquid enters downwards the second space and enters the first space via the second space, and then is gas-lifted and output;

c. continuous drainage and production stage, after the water drainage and gas production stage, using the air compressor to input the pressurized gas into the first space, the pressure-control valve and the air compressor are used to maintain a preset pressure in the first space and the second space, and the well liquid is drained out via the second space and the formation gas is produced from the third space.

12. The method of claim 11, wherein in the continuous drainage and production stage, closing the inner pipe so that the first space and the second space are communicated controllably by the pressure-control valve, and when the pressure of the well liquid in the second space reaches a set value, the pressurized gas in the first space enters the second space and automatically gas-lifts the well liquid in the second space by gas lift, and when the pressure of the well liquid in the second space is below the set value, the gas pressure in the first space rises in response thereto, when the gas pressure in the first space reaches a set pressure value, the air compressor stops, and the gas pressure in the first space is below the set pressure value, the air compressor reactivates, and, throughout the continuous drainage and production stage, the pressure-control valve is automatically open and closed as the well liquid in the second space increases or decreases, the gas pressure in the first space controls the start and stop of the air compressor, and then maintaining the preset pressure in the first space and the second space.

13. The method of claim 11 further comprising d. in a cleaning stage, closing the first space, and injecting the water into the second space to conduct the cleaning, and washing out impurities in the device for water drainage and gas production by pressure control and gas lift from the third space, and then the water drainage and pressure decrease stage, repeating the water drainage and gas production stage and the continuous drainage and production stage successively to recover production.

14. The method of claim 13, further comprising, in the cleaning stage, opening the bidirectional valve arranged at the bottom of the intermediate pipe reversely under a condition of a high pressure of the second space resulting from the injection of the water into the second space, and water flows from the second space through the bidirectional valve in the third space, and then flows to the ground from the third space to complete the cleaning.

* * * * *